United States Patent [19]

Migliori et al.

[11] Patent Number: 4,560,849

[45] Date of Patent: Dec. 24, 1985

[54] FEEDBACK REGULATED INDUCTION HEATER FOR A FLOWING FLUID

[75] Inventors: Albert Migliori, Santa Fe; Gregory W. Swift, Los Alamos, both of N. Mex.

[73] Assignee: The United States of America as represented by the United States Department of Energy, Washington, D.C.

[21] Appl. No.: 620,287

[22] Filed: Jun. 13, 1984

[51] Int. Cl.[4] ..... H05B 6/08

[52] U.S. Cl. ..... 219/10.51; 219/10.77; 219/10.49 R; 219/494; 219/325

[58] Field of Search ..... 29/10.51, 10.49 R, 10.65, 29/10.77, 10.75, 494, 510; 219/325, 307

[56] References Cited

U.S. PATENT DOCUMENTS

| | | | |
|---|---|---|---|
| 1,745,068 | 1/1930 | Veronneau | 219/325 X |
| 2,494,716 | 1/1950 | McMahon et al. | 219/10.51 |
| 2,585,970 | 2/1952 | Shaw | 219/10.65 X |
| 2,773,161 | 12/1956 | Baker | 219/10.77 |
| 3,461,215 | 8/1969 | Reboux | 219/10.49 R X |
| 3,612,165 | 10/1971 | Haynes . | |
| 3,740,859 | 6/1973 | Patton et al. | 219/10.77 X |
| 4,089,176 | 5/1978 | Ashe | 219/10.51 X |
| 4,341,936 | 7/1982 | Virgin | 219/10.51 |
| 4,431,890 | 2/1984 | Ramer | 219/10.51 |

OTHER PUBLICATIONS

Dymott, "An Apparatus Delivering Water at Constant Temperature", Jul. 1951.

Diamond, "An Inductive Water Thermostat Using On-Off Triac Control and Platinum Sensing, Review of Scientific Instruments, vol. 42, No. 1, Jan. 1971.

Lee et al., "Precise Temperature Control for Growth of Silicon Crystals", Jan. 1976.

Harvey, "Precision Temperature-Controlled Water Bath", Review of Scientific Instruments, vol. 39, No. 1, Jan. 1968.

Larsen, "50 Microdegree Temperature Controller", Review of Scientific Instruments, vol. 39, No. 1, Jan. 1968.

Priel, "Thermostat with a Stability of ±3.5 μK", Research Papers, Institute of Physics, p. 27, 1978.

Brabson, "Temperature Control Using a Platinum Resistance Sensor", Review of Scientific Instrument, Mar. 1973.

Dratler, Jr. "A Proportional Thermostat with 10 Microdegree Stability", Review of Scientific Instruments, vol. 45, No. 11, Nov. 1974.

Sloman, "On Microdegree Thermostats", 1977 National Semi Conductor FET Data Book, p. 967.

*Primary Examiner*—Philip H. Leung

*Attorney, Agent, or Firm*—William A. Eklund; Paul D. Gaetjens; Judson R. Hightower

[57] ABSTRACT

A regulated induction heater for heating a stream of flowing fluid to a predetermined desired temperature. The heater includes a radiofrequency induction coil which surrounds a glass tube through which the fluid flows. A heating element consisting of a bundle of approximately 200 stainless steel capillary tubes located within the glass tube couples the output of the induction coil to the fluid. The temperature of the fluid downstream from the heating element is sensed with a platinum resistance thermometer, the output of which is applied to an adjustable proportional and integral feedback control circuit which regulates the power applied to the induction coil. The heater regulates the fluid temperature to within 0.005° C. at a flow rate of 50 $cm^3$/second with a response time of less than 0.1 second, and can accommodate changes in heat load up to 1500 watts.

3 Claims, 3 Drawing Figures

FEEDBACK REGULATED INDUCTION HEATER FOR A FLOWING FLUID

BACKGROUND OF THE INVENTION

The invention disclosed herein is generally related to heaters and temperature controllers for fluids. More particularly, this invention is related to feedback controlled heaters and temperature regulators for flowing liquids. This invention is the result of a contract with the U.S. Department of Energy (Contract No. W-7405-ENG-36).

The present invention was developed to meet a need for a temperature controller capable of maintaining a circulating stream of liquid at a constant temperature. The particular need was for an experimental heat engine which must be heated or cooled with a stream of water which is maintained at a substantially constant temperature. It will be recognized however that there are various other applications in which there is required a stream of water heated to a constant temperature.

Common electrical resistive heating devices suffer from certain disadvantages. For example, they must be provided with electrical feedthroughs into the fluid stream. Also, they must be insulated with insulation that can withstand prolonged exposure to fluid, typically water, at an elevated temperature. Such insulation necessarily decreases the efficiency and speed of heat transfer to the fluid. A key problem, however, is how to drive such a heater. A phase controlled SCR could be used, but it would generate noise from 60 Hz to approximately one MHz and, at the power levels required, shielding would be difficult because of the low frequency components. A preferred way would be to use a switching-regulated power supply, so that low-frequency noise would be eliminated. With modern FET power transistors, two semiconductors would be able to accommodate up to 10 kilowatts at 200 kHz. However, such a power supply, coupled to a resistive heater, would still suffer from the disadvantages of the use of feedthroughs, insulation and the noise problem mentioned above.

Accordingly, it is the object and purpose of the present invention to provide a regulated heater for heating a flowing stream of liquid, which is subject to temperature fluctuations, to a predetermined desired temperature.

It is also an object of the present invention to provide a feedback regulated heater which can efficiently apply large amounts of heat, within a short response time, to a flowing fluid which is subject to rapid temperature fluctuations so as to maintain the fluid at a substantially constant temperature.

It is another object of the invention to provide such a heater in which the active heating element has a low heat capacity and is free of electrical insulation, leads and feedthroughs.

SUMMARY OF THE INVENTION

To achieve the foregoing and other objects, and in accordance with the purposes of the present invention as embodied and broadly described herein, the regulated induction heater of the present invention comprises a radiofrequency induction coil surrounding a tubular conduit through which the fluid flows, a variable output power supply for energizing the induction coil; a heating element located within the conduit which couples the output of the induction coil to the flowing fluid; a temperature sensor located downstream from the heating element which produces an electrical temperature signal representative of the temperature of the fluid; and an adjustable proportional and integral feedback control circuit which is responsive to the temperature signal and which operates to control the output of the power supply to maintain the flowing fluid at a substantially constant predetermined temperature.

In accordance with another aspect of the invention, the heating element consists of a bundle of stainless steel capillary tubes contained within the fluid conduit. The advantage of this arrangement is that the capillary tubes have a low heat capacity and low resistance to fluid flow, yet have a large surface-to-mass ratio, thereby enabling large amounts of heat to be rapidly and efficiently applied to the flowing fluid.

These and other aspects of the present invention will be apparent upon consideration of the following detailed description of the preferred embodiment of the invention and the accompanying drawings.

BRIEF DESCRIPTION OF THE DRAWINGS

The accompanying drawings, which are incorporated in and form a part of the specification, illustrate a preferred embodiment of the present invention and, together with the detailed description set forth below, serve to explain the principles of the invention. In the drawings.

DETAILED DESCRIPTION OF THE PREFERRED EMBODIMENT

Figure 1:
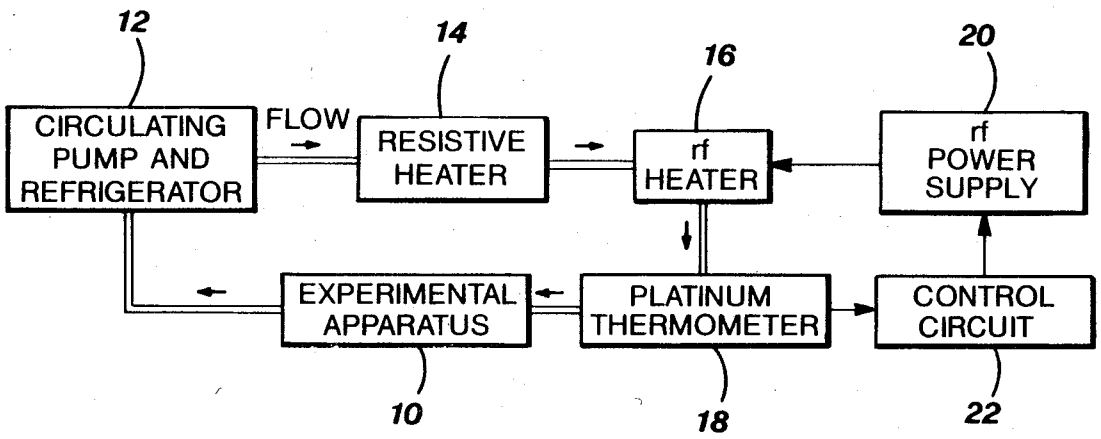
FIG. 1 is a schematic block diagram of a circulating water system including the regulated induction heater of the present invention.

FIG. 1 illustrates a system in which the preferred embodiment of the present invention is employed. The system provides a circulating stream of constant-temperature water to an experimental apparatus 10. The experimental apparatus 10 forms no part of the present invention, and may in practice be any apparatus that requires heating or cooling with a stream of constant-temperature water. Briefly, water is circulated by means of a circulating pump 12 which includes a refrigerator. The refrigerated water is circulated from the pump 12 past a resistive heater 14, then past a radiofrequency (rf) induction heater 16 and a platinum thermometer 18 to the experimental apparatus 10, and back to the circulating pump 12. The pump 12 and resistive heater 14 form no part of the present invention. The present invention includes the rf induction heater 16, the platinum thermometer 18, and rf power supply 20, and a proportional/integral feedback control circuit 22.

In operation, water returning from the experimental apparatus 10 is cooled at the pump 12, then subsequently heated to an intermediate temperature by the resistive heater 14. The water emerging from the resistance heater 14 is subsequently heated further to the desired temperature by the induction heater 16. In this regard, the platinum thermometer 18 and the feedback control circuit 22 operate to control the output of the rf power supply 20 so as to heat the water to a desired temperature notwithstanding minor temperature fluctuations in the flowing stream.

In the illustrated system the pump 12 is a commercially available 2.1 kilowatt closed system water chiller and circulating pump. The resistive heater 14 is a commercially available bendable tubular heater 183 cm long and is rated at 2 kilowatts at 230 volts ac. The resistive heater 14 is mounted in a section of 1.27-cm-diam soft copper tubing which contains the flowing water. Electrical power to the resistive heater 14 is set by a 230 volt-ac, 15 amp variable autotransformer.

Figure 2:
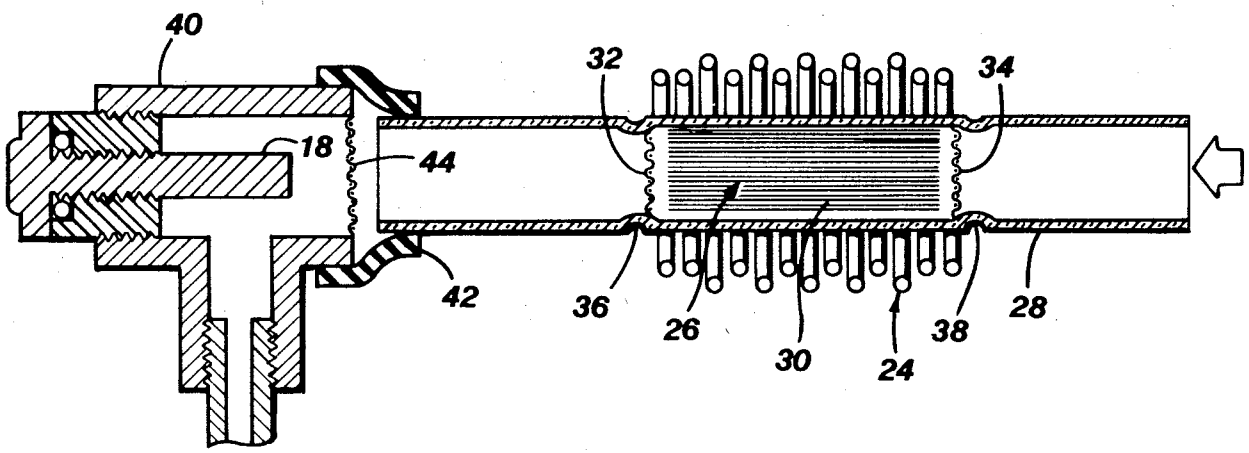
FIG. 2 is an illustration of the rf induction heater assembly of FIG. 1.

Referring to FIG. 2, the induction heater 16 includes an oil cooled rf coupling coil 24 which is wound of two layers of 0.63 cm diameter soft-drawn copper tubing. The inner layer has 8 turns and the outer layer has 5 turns. The overall length of the coil 24 is approximately 8 cm. The inside and outside diameters are approximately 3.5 and 7.0 cm respectively.

The power supply 20 which drives the rf coil 24 is a 2.5 kilowatt, 500 kilohertz power supply. The output of the power supply 20 is controlled by the control circuit 22. The output of the control circuit 22 is a variable 0-to-6 volt dc control signal which is applied to a stepless SCR controller associated with the power supply, and which is commercially available from West Instrument Corp. of Schiller Park, Ill.

The rf output from the coil 24 is coupled to a heating element 26 which is located inside a 1.5 cm-diam glass tube 28 through which the flowing water passes. The heating element 26 consists of a bundle of approximately 200 stainless steel (type 304) capillary tubes 30, which are held in place by means of stainless steel screens 32 and 34, which are in turn held in place by crimps 36 and 38 in the glass tube 28. The advantage of this type of heating element is that it has a very low heat capacity, a low resistance to fluid flow, and a high surface to volume ratio, thereby enabling very rapid and efficient transfer of heat to the flowing water. With this arrangement 1.5 kilowatts of heat can be delivered to the flowing stream of water.

The temperature of the stream flowing from the induction heater 16 is sensed with the platinum resistance thermometer 18, which is located 8 cm downstream from the induction heating element 26. The platinum thermometer 18 has a resistance of 200 ohms at 25° C., and its response time to changes in water temperature is about 0.1 second. To ensure that stray rf energy from the induction coil 24 is not transmitted to the platinum thermometer, the thermometer is encased in a brass pipe fitting 40 which is connected to the glass tube 28 by a rubber tube 42. A 100-mesh copper screen 44 at the opening of the brass fitting further insulates the thermometer from stray rf radiation.

Figure 3:
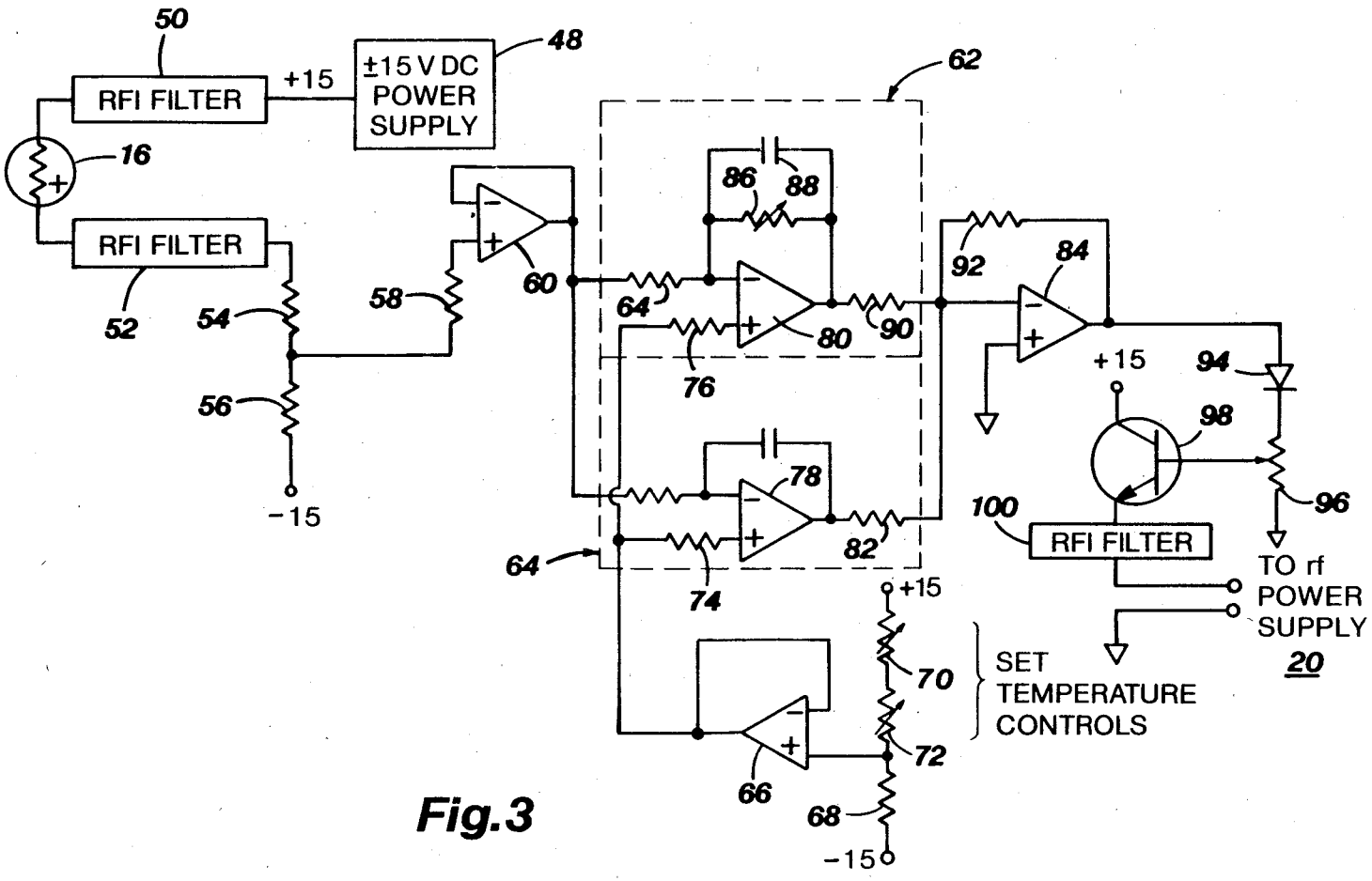
FIG. 3 is a schematic electrical diagram of the feedback control circuit which controls the induction heater assembly.

The feedback control circuit 22 is illustrated schematically in FIG. 3. Briefly, the circuit utilizes a proportional-integral feedback control signal to control the output of the induction heater power supply 20. The circuit 22 is powered by a regulated ±15 volt-dc, 100 mA power supply 48 with a stability of 1 mV and ripple of 0.15 mV. Referring to FIG. 3, the power supply 48 applies a 15 volt dc signal through a radio-frequency interference (RFI) filter 50 and through the platinum resistance thermometer 18 and a second RFI filter 52 to a voltage divider consisting of a 800 ohm wirewound resistor 54 and a one-kilohm wirewound resistor 56 connected in series. The output from the voltage divider is applied through a 10 kilohm resistor 58 to the positive input of a OP-07E operational amplifier (op amp) 60 which is configured to operate as a voltage follower. The output of the op amp 60, which is essentially a temperature feedback signal, is applied to the inputs of a proportional gain amplifier 62 and an integrating amplifier 64, which are described further below.

The desired temperature is set by means of a buffer op amp 66 which receives as its input the output of a variable voltage divider consisting of a 5 kilohm resistor 68 and variable 10 kilohm and 2 kilohm resistors 70 and 72, respectively, which function as coarse and fine temperature set point controls. The output of the op amp 66 is a reference voltage which is applied through a pair of 10 kilohm resistors 74 and 76 to the positive inputs of op amps 78 and 80 associated with the integral and proportional gain amplifiers 64 and 62.

The proportional and integral amplifiers 62 and 64 act in a feedback capacity to control the induction heater so that the temperature feedback signal from op amp 60 is equal to the reference signal from the op amp 66. More specifically, the integral gain amplifier includes op amp 78 with a 0.33 microfarad capacitor interposed between the negative input and the output of the op amp 78. The output of the op amp 78, which represents the time integral of the temperature error, or difference between the temperature feedback signal and the reference signal, is applied through a 10 kilohm resistor 82 to the negative input of a proportional gain summing amplifier 84.

The proportional gain amplifier 62 consists of op amp 80 with a 500 kilohm variable resistor 86 and a 0.01 microfarad capacitor interposed in parallel between the negative input and the output of the op amp 80. The 500 kilohm variable resistor 86 operates to control the gain of the amplifier. The output of the op amp 80, which is a proportional gain control signal, is applied through a 10 kilohm resistor 90 to the summing amplifier 84 where it is combined with the integral gain control signal from the integral amplifier 64. The summing amplifier 84 has a 10 kilohm resistor interposed between its negative input and its output, such that the gain of the op amp is one with respect to the outputs of op amps 78 and 80.

The output of the summing op amp 84 is applied through a diode 94 (IN4154) and a variable 10 kilohm resistor 96 to the base of a 2N5320 transistor 98. The output of the transistor 98 is applied through RFI filter 100 to the West SCR controller for the induction heater power supply.

Each of the op amps described above is a OP-07E op amp wired with a variable 20 kilohm resistor between its pins numbered 1 and 8 to provide for offset trim adjustment of the op amp. These op amps have a voltage noise of 10 mV/(Hz)$^{\frac{1}{2}}$ and a long-term dc stability of 0.2 microvolt/month. The selection of the op amps is important, as the long-term stability of the controller is ultimately determined by the offset drift of these amplifiers. All control electronics are encased in an aluminum box to ensure against interference from the induction coil, and all leads into and out of the box pass through RFI filters.

The proportional-integral amplifier must have its proportional gain set such that the sum of the proportional response and the integral response (integrated over the time it takes the water to travel from the heating element to the platinum thermometer) produces a temperature change less than the temperature error. The fast transient response of the controller is essentially that of the proportional signal and can be easily measured by changing the temperature set point and observing the size of the step increase in temperature that is obtained. The long term response is completely determined by the integrator and can be measured by observing the temperature drift with a slowly responding thermometer.

In operation, the circulation pump 12 is turned on and the coarse and fine set-point temperature controls are adjusted to correspond to the platinum thermometer voltage at the desired temperature. The refrigeration unit and the resistive heater 14 are adjusted such that the output power of the induction heater 16 is at a level at which expected transients can be accommodated. For example, if it is expected that the heat load will decrease during the course of a measurement by one kilowatt, the normal induction heater output should be at least one kilowatt.

Tests of the controller were conducted using no external thermal load and a water flow rate of 50 $cm^3$/second, with the temperature set at 17° C. Under these conditions the minimum system response time is approximately 200 milliseconds, and is largely determined by the distance from the heating element to the thermometer.

Long-term stability of the system has been determined using an independent thermometer to measure the temperature of the fluid. The voltage across the platinum thermometer was also independently monitored with a voltmeter. Over a four hour period the observed peak-to-peak temperature excursion was 0.01° C., and was consistent with the observed drift in the platinum thermometer voltage. Also observed was an approximately 0.006° C.-rms temperature noise in the platinum thermometer, using a strip chart recorder having a 100 millisecond response time.

Because of the nature of the proportional-integral control, a constant rate of change of heat carried by the flowing water will produce a constant temperature error. This error was measured by varying the power delivered by the resistive heater at a rate of 28 watts per second from 160 to 900 watts. This was observed to result in a constant temperature error of 0.070° C.

The foregoing description of the preferred embodiment of the invention has been presented for purposes of illustration and description. It is not intended to be exhaustive or to limit the invention to the precise form disclosed, and various modifications and substitutions are possible in light of the above teaching.

The preferred embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A regulated induction heater for heating a stream of flowing liquid to a predetermined desired temperature, comprising:

a. a radiofrequency (rf) induction coil and a tubular conduit inside said induction coil through which said flowing fluid is passed, a heating element contained within said conduit, said heating element comprising a plurality of stainless steel capillary tubes aligned with the direction of fluid flow, and a variable output rf power supply for energizing said induction coil;

b. temperature sensing means located in said conduit downstream from said heating element for sensing the temperature of the flowing fluid and producing a temperature signal representative thereof; and c. adjustable proportional and integral feedback control circuit which is responsive to said temperature signal and which produces a temperature error signal representative of the difference between the measured temperature and the desired temperature, said feedback control circuit including a proportional gain amplifier and an integrating amplifier, said proportional gain amplifier operating in response to said temperature error signal to produce a proportional gain control signal, said integral amplifier operating in response to said temperature error signal to produce an integral gain control signal, said proportional gain control signal and said integral gain control signal being summed to produce a feedback control signal which is applied to said power supply to control the power output thereof and thereby heat the stream of fluid to said predetermined desired temperature, and wherein said proportional gain amplifier has a proportional gain which is set such that said feedback control signal, when applied to said power supply, produces a temperature change in said fluid which is less than the temperature change represented by said temperature error signal.

2. The heater defined in claim 1 wherein said temperature sensing means is a platinum resistance thermometer.

3. The heater defined in claim 1 wherein said induction coil is formed of oil cooled copper tubing formed in two concentric tubular windings.

* * * * *